US005277549A

United States Patent [19]

Chen et al.

[11] Patent Number: 5,277,549

[45] Date of Patent: Jan. 11, 1994

[54] CONTROLLED REACTION L-2R STEAM TURBINE BLADE

[75] Inventors: Shun Chen, Winter Springs; Jurek Ferleger, Longwood, both of Fla.

[73] Assignee: Westinghouse Electric Corp., Pittsburgh, Pa.

[21] Appl. No.: 851,710

[22] Filed: Mar. 16, 1992

[51] Int. Cl.[5] ..... F01D 5/14

[52] U.S. Cl. ..... 416/223 A; 415/181

[58] Field of Search ..... 415/181; 416/223A, DIG. 2

[56] References Cited

U.S. PATENT DOCUMENTS

| | | | |
|---|---|---|---|
| 2,934,259 | 4/1960 | Hausmann | 415/181 |
| 3,475,108 | 10/1969 | Zickuhr | 416/223 A |
| 4,533,298 | 8/1985 | Partington et al. . | |
| 4,616,975 | 10/1986 | Duncan | 415/181 |
| 4,676,723 | 6/1987 | Kiger et al. . | |
| 4,718,172 | 1/1988 | Rouse et al. . | |
| 4,765,046 | 8/1988 | Partington et al. . | |
| 4,900,230 | 2/1990 | Patel . | |
| 4,919,593 | 4/1990 | Brown . | |
| 5,088,894 | 2/1992 | Patel | 416/223 A |

FOREIGN PATENT DOCUMENTS

| | | | |
|---|---|---|---|
| 0702966 | 1/1954 | Canada | 415/181 |

*Primary Examiner*—Edward K. Look
*Assistant Examiner*—Christopher M. Verdier
*Attorney, Agent, or Firm*—M. G. Panian

[57] ABSTRACT

A high performance steam turbine blade is provided in which the geometry of the blade airfoil is configured to minimize energy loss through the row of blades and control the radial distribution of the degree of reaction. The velocity of the steam over the blade surface is minimized to reduce friction losses, rapid deceleration of the steam velocity as it expands toward the trailing edge is avoided to prevent boundary layer separation and the reaction distribution is adjusted so that a relatively high reaction occurs at the base of the airfoil, thereby reducing secondary flow, and a relatively low reaction occurs at tip of the airfoil, thereby minimizing tip leakage. Specifically, the radial reaction distribution is such that in the hub region at least 20% of the stage pressure drop occurs in the blade row and in the tip region less than 50% of the stage pressure drop occurs in the blade row.

7 Claims, 5 Drawing Sheets

CONTROLLED REACTION L-2R STEAM TURBINE BLADE

BACKGROUND OF THE INVENTION

The present invention relates to blades for a steam turbine rotor. More specifically, the present invention relates to a high performance controlled reaction blade for use in the stage that is one stage upstream from the next to the last stage in a low pressure steam turbine.

The steam flow path of a steam turbine is formed by a stationary cylinder and a rotor. A large number of stationary vanes are attached to the cylinder in a circumferential array and extend inward into the steam flow path. Similarly, a large number of rotating blades are attached to the rotor in a circumferential array and extend outward into the steam flow path. The stationary vanes and rotating blades are arranged in alternating rows so that a row of vanes and the immediately downstream row of blades forms a stage. The vanes serve to direct the flow of steam so that it enters the downstream row of blades at the correct angle. The blade airfoils extract energy from the steam, thereby developing the power necessary to drive the rotor and the load attached to it.

The amount of energy extracted by each row of rotating blades depends on the size and shape of the blade airfoils, as well as the quantity of blades in the row. Thus, the shapes of the blade airfoils are an extremely important factor in the thermodynamic performance of the turbine and determining the geometry of the blade airfoils is a vital portion of the turbine design.

As the steam flows through the turbine its pressure drops through each succeeding stage until the desired discharge pressure is achieved. Thus, the steam properties—that is, temperature, pressure, velocity and moisture content—vary from row to row as the steam expands through the flow path. Consequently, each blade row employs blades having an airfoil shape that is optimized for the steam conditions associated with that row. However, within a given row the blade airfoil shapes are identical, except in certain turbines in which the airfoil shapes are varied among the blades within the row in order to vary the resonant frequencies.

The difficulty associated with designing a steam turbine blade is exacerbated by the fact that the airfoil shape determines, in large part, the mechanical strength of the blade and its resonant frequencies, as well as the thermodynamic performance of the blade. These considerations impose constraints on the choice of blade airfoil shape so that, of necessity, the optimum blade airfoil shape for a given row is a matter of compromise between its mechanical and aerodynamic properties.

Generally, major losses in the blade row may occur due to four phenomena—(i) friction losses as the steam flows over the airfoil surface, (ii) losses due to separation of the boundary layer on the suction surface of the blade, (iii) secondary flows in the steam flowing through the channel formed by adjacent blades and the end walls, and (iv) steam leakage past the blade tip. Friction losses are minimized by maintaining the velocity of the steam at relatively low values. Separation of the boundary layer is prevented by ensuring that the steam does not decelerate too rapidly as it expands toward the trailing edge of the airfoil. Losses due to secondary flow and tip leakage may be minimized by controlling the radial reaction distribution along the airfoil.

In a reaction turbine, the airfoils of the stationary vanes and the rotating blades are designed so that a portion of the stage pressure drop occurs in the row of vanes and essentially the balance of the stage pressure drop occurs in the row of blades. The degree of reaction in a turbine stage is defined as the percentage of the stage pressure drop that occurs in the rotating blade row and is an important parameter in blade design. Traditionally, the reaction at the base of the blade airfoil was maintained at approximately 10–15%—that is, in the vicinity of the hub of the stage, 10–15% of the stage pressure drop occurred in the row of blades and 85–90% occurred in the upstream row of vanes. The reaction at the tip of the airfoil was traditionally maintained at approximately 65%. However, such a radial reaction distribution can result in significant secondary flow at the base of the airfoil and high leakage across the tip of the airfoil, both of which adversely affect the performance of the blade, as explained above.

It is therefore desirable to provide a row of steam turbine blades that provides high performance by use of an airfoil shape that maintains the steam velocity at relatively low values, ensures that the steam does not decelerate too rapidly as it expands toward the trailing edge, and controls the reaction so as to produce a radial reaction distribution that tends to minimize secondary flow at the base of the airfoil and steam leakage at the tip.

SUMMARY OF THE INVENTION

Accordingly, it is the general object of the current invention to provide a row of steam turbine blades that provides high performance by use of an airfoil shape that maintains the steam velocity at relatively low values, ensures that the steam does not decelerate too rapidly as it expands toward the trailing edge, and that controls the reaction so as to produce a radial reaction distribution that tends to minimize secondary flow at the base of the airfoil and steam leakage at the tip.

Briefly, this object, as well as other objects of the current invention, is accomplished in a steam turbine comprising (i) a stationary cylinder for containing a steam flow, (ii) a rotor enclosed by the cylinder, and (iii) a stage having means for at least partially expanding the steam flow, whereby the steam flow undergoes a stage pressure drop as it expands through the stage. The stage has (i) a row of vanes, (ii) a row of blades, (iii) a tip region, and (iv) a hub region. The row of vanes has means for causing the steam to undergo a first portion of the stage pressure drop as the steam flows through the row of vanes. The row of blades has (i) means for causing the steam to undergo a second portion of the stage pressure drop as the steam flows through the row of blades, and (ii) means for controlling the radial distribution of the second portion of the stage pressure drop so that the second portion is greater than approximately 20% of the stage pressure drop in the hub region and less than approximately 50% of the stage pressure drop in the tip region.

DESCRIPTION OF THE PREFERRED EMBODIMENT

Figure 1:
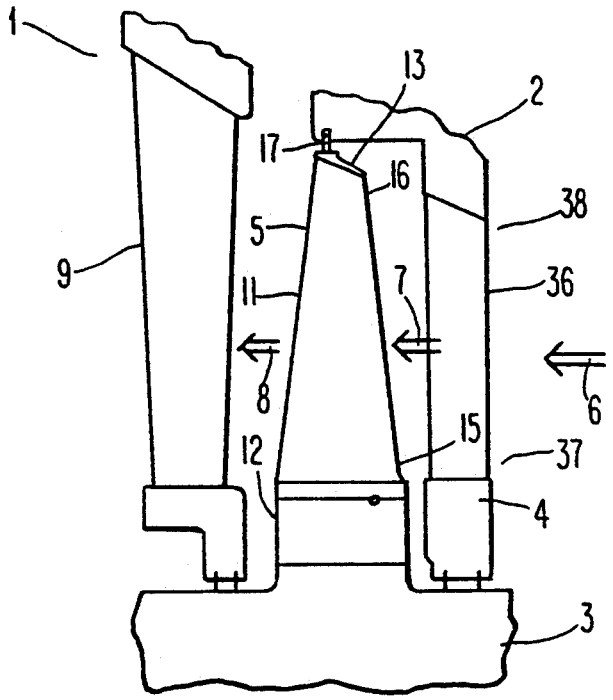
FIG. 1 is a portion of a cross-section through a steam turbine in the vicinity of the stage containing the L-2R blade according to the current invention.

Referring to the drawings, there is shown in FIG. 1 a portion of a cross-section through the low pressure section of a steam turbine 1. As shown, the steam flow path of the steam turbine 1 is formed by a stationary cylinder 2 and a rotor 3. A row of L-2R blades 5 are attached to the periphery of the rotor 3 and extend radially outward into the flow path in a circumferential array. A row of vanes 4 of a diaphragm structure are attached to the cylinder 2 and extend radially inward in a circumferential array immediately upstream of the row of blades 5. As previously discussed, the vanes 4 have airfoils 36 that cause the steam 6 to undergo a portion of the stage pressure drop as it flows through the row of vanes. The vane airfoils 36 also serve to direct the flow of steam 6 entering the stage so that the steam 7 enters the row of blades 5 at the correct angle. The row of vanes 4 and the row of blades 5 together form a stage. The stage has a hub portion 37 and a tip portion 38. A second row of vanes 9 of a segmental assembly structure is disposed immediately downstream of the blades 5 and serves to direct the flow of steam 8 exiting the stage to the correct angle for the L-1R row of blades (not shown).

As shown in FIG. 1, each blade 5 is comprised of an airfoil portion 11 that extracts energy from the steam 7 and a root portion 12 that serves to fix the blade to the rotor 3. The airfoil 11 has a base portion 15 at its proximal end adjacent the root 12 in the hub region of the stage and a tip portion 16 at its distal end in the tip region of the stage. A shroud 13 is integrally formed at the airfoil tip 16. Such an integral shroud is disclosed in U.S. Pat. No. 4,533,298 (Partington et al.), assigned to the same assignee as the current invention and herein incorporated by reference in its entirety. The integral shroud 13, in conjunction with a seal 17, serves to minimize the leakage of steam past the blade row.

Figure 2:
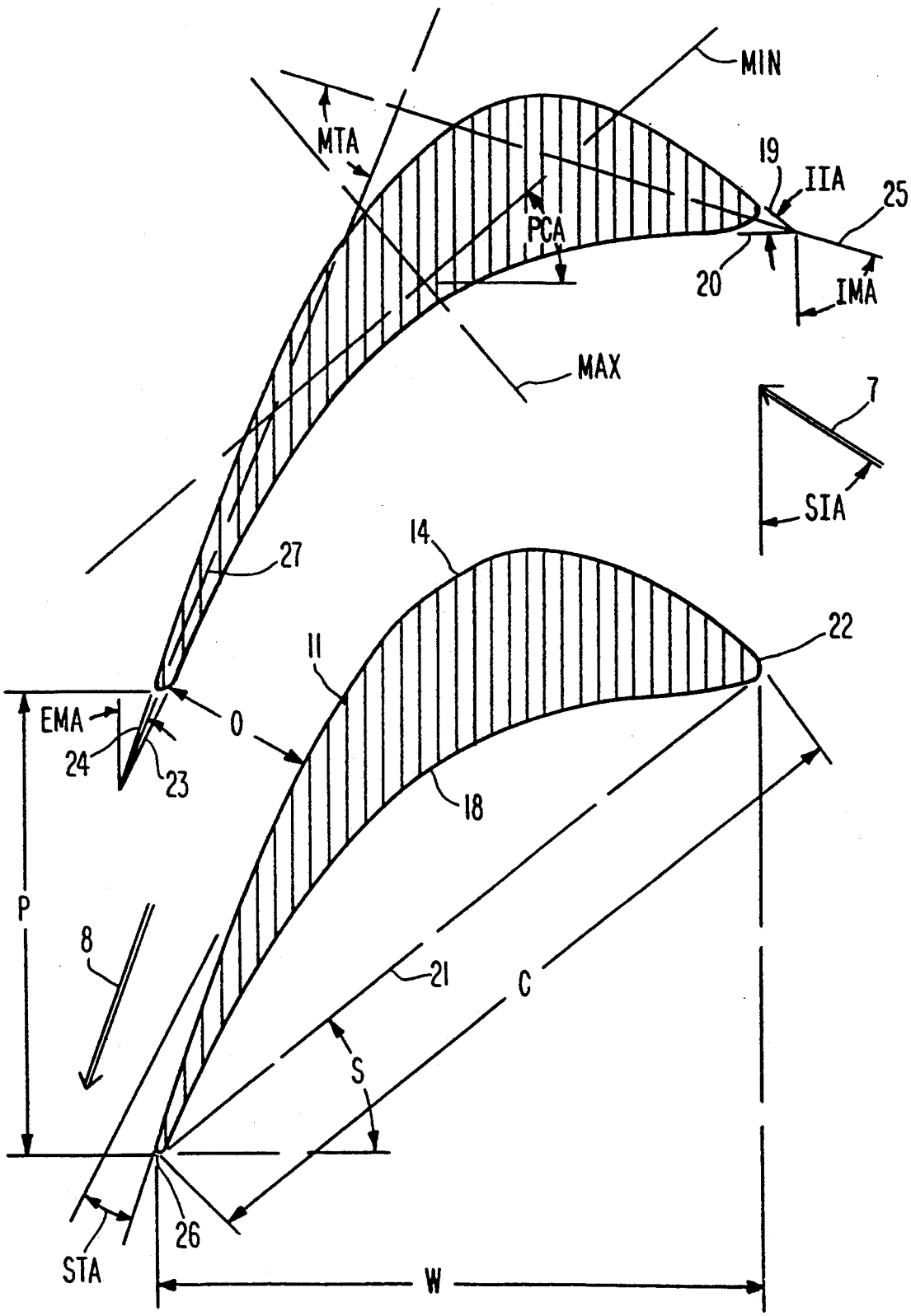
FIG. 2 is a diagram of two adjacent blades according to the current invention illustrating various performance related parameters.

The current invention concerns the airfoil 11 of the blade 5. More specifically, the current invention concerns a novel airfoil shape that greatly minimizes the losses that the steam 7 flowing through the blade row experiences, thereby increasing the performance of the blade and the thermodynamic efficiency of the turbine. Accordingly, FIG. 2 shows two adjacent blade airfoils 11 that form a portion of the blade row. Each airfoil has a leading edge 22, a trailing edge 26, a convex or suction surface 14 and a concave or pressure surface 18. The novel geometry of the airfoil 11 for the L-2R blade of the current invention is specified in Table I by the relevant parameters, each of which is discussed below (all angles in Table I are expressed in degrees), and illustrated in FIG. 3.

In Table I, each parameter is specified at five radial stations along the airfoil—specifically, (i) at the base of the airfoil, corresponding to a radius of 673 mm (26.5 in), (ii) at 25% height, corresponding to a radius of 724 mm (28.5 in), (iii) at mid-height, corresponding to a radius of 800 mm (31.49 in), (iv) at 75% height, corresponding to a radius of 864 mm (34.0 in), and (v) at the tip of the airfoil at the juncture of the integral shroud and the airfoil trailing edge, corresponding to a radius of 926 mm (36.47 in). As those skilled in the art of blade design will appreciate, the values of the parameters shown in Table I for the radial stations at the base of the airfoil and at the tip do not correspond to the actual physical geometry of the blade but are based on extrapolations that are used by blade designers to define the airfoil geometry. This is so because at the base of the airfoil a fillet is formed that distorts the actual values and because the 926 mm radius station (the tip) is actually within the shroud.

TABLE I

| Parameter | Base | 25% | Mid | 75% | Tip |
|---|---|---|---|---|---|
| Pitch/Chord Ratio | .52 | .61 | .72 | .77 | .79 |
| Pitch/Width Ratio | .55 | .67 | .94 | 1.32 | 1.99 |
| Stagger Angle | 16.7 | 25.4 | 40.7 | 54.4 | 67.1 |
| Max Thickness/Chord | .25 | .25 | .21 | .12 | .07 |
| Metal Turning Angle | 116.4 | 106.0 | 83.9 | 61.3 | 36.3 |
| Exit Opening (mm) | 20.7 | 20.8 | 21.3 | 21.6 | 19.4 |
| Exit Opening Angle | 32.6 | 32.7 | 30.7 | 29.5 | 22.5 |
| Inlet Metal Angle | 42.6 | 54.5 | 77.6 | 101.8 | 128.5 |
| Inlet Included Angle | 30.4 | 41.6 | 51.1 | 40.1 | 32.5 |
| Exit Metal Angle | 21.1 | 19.5 | 18.6 | 16.9 | 15.2 |
| Suction Surface Turning Angle | 15.6 | 15.7 | 15.0 | 13.9 | 8.9 |

The chord of the blade is the distance from the leading edge 22 to the trailing edge 26 and is indicated as C in FIG. 2. The width of the blade refers to the distance from the leading to the trailing edge in the axial direction—that is, the axial component of the chord—and is indicated by W in FIG. 2. The pitch is the distance in the tangential direction between the trailing edges of adjacent blades and is indicated in FIG. 2 as P. The pitch to width ratio and the pitch to chord ratio are important parameters in determining the performance of a row of blades since there is an optimum value of each of these parameters that will yield the minimum blade loss—if the values are too large, meaning there are few blades, then each blade will carry too much load and flow separation may occur, if the values are too high, meaning there are many blades, the surface friction will become excessive. Consequently, these parameters are included in Table I.

The stagger angle is the angle the line 21 drawn from the leading to the trailing edge makes with the axial direction and is indicated in FIG. 2 as S.

The maximum thickness to chord ratio is the ratio of the maximum thickness of the airfoil transverse cross-section at the radial station to the chord length at that station.

The metal turning angle is indicated as MTA in FIG. 2 and given by the equation MTA=180°-(IMA+EMA), where IMA and EMA are the inlet and exit metal angles, respectively, as defined below.

Figure 4:
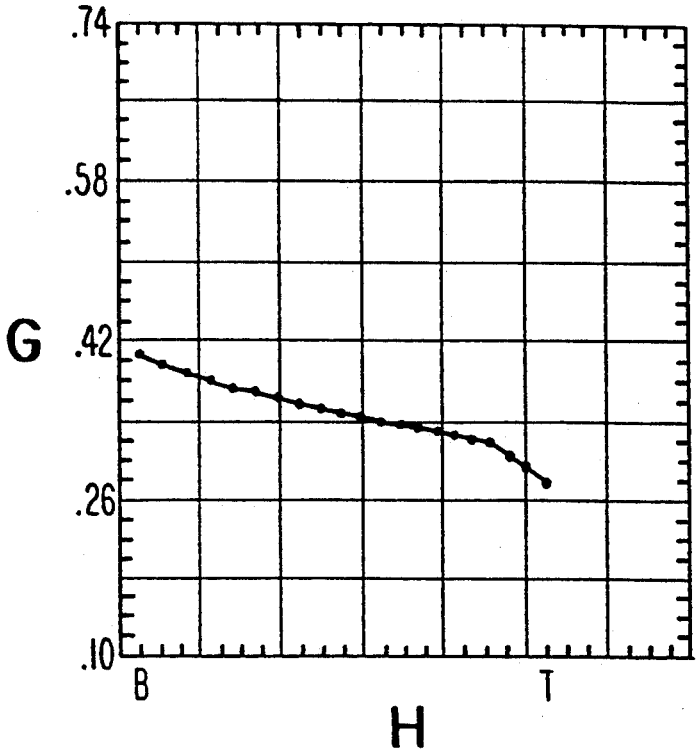
FIG. 4 is a graph showing the calculated radial distribution of the gauging G of the blade row according to the current invention from the base B of the airfoil to the tip T.

The exit opening, or throat, is the shortest distance from the trailing edge 26 of one blade to the suction surface 14 of the adjacent blade and is indicated in FIG. 2 by 0. The gauging of the blade row is defined as the ratio of the throat to the pitch and indicates the percentage of the annular area available for steam flow. The gauging parameter is used in the blade according to the current invention to control the degree of reaction, as discussed further below. FIG. 4 shows the radial distribution of the gauging of the blade airfoil 11 of the current invention from the base 15, indicated by B in FIG. 4, to the tip 16, indicated by T in FIG. 4. As can be seen, the radial gauging distribution is unconventional in that the gauging is larger at the base of the blade than at the tip. Preferably, the gauging decreases from at least approximately 25% from the base to the tip. As shown in FIG. 4, in the preferred embodiment, the gauging decreases from approximately 0.41 at the base to approximately 0.28 at the tip. Such a radial gauging distribution is a result of the novel control of the radial distribution of the blade row reaction according to the current invention, as discussed further below.

The exit opening angle is the arc sin of the gauging.

The inlet metal angle is the angle formed between the circumferential direction and the line 25 that bisects the lines 19 and 20, lines 19 and 20 being the lines that are tangent with the suction surface 11 and the pressure surface 18, respectively, at the leading edge 22. The inlet metal angle is indicated in FIG. 2 as IMA.

The inlet included angle is the angle between the tangent lines 19 and 20 and is indicated in FIG. 2 as IIA. Selection of the inlet included angle involves a tradeoff since a large inlet included angle improves performance at off-design conditions, while a small inlet angle results in the optimum performance at design conditions.

The exit metal angle is the angle formed between the circumferential direction and the line 27 that bisects the lines 23 and 24, lines 23 and 24 being the lines that are tangent with the suction surface 11 and the pressure surface 18, respectively, at the trailing edge 26. The exit metal angle is indicated in FIG. 2 as EMA.

The suction surface turning angle is the amount of the suction surface turning from the throat O to the trailing edge 26 and is indicated in FIG. 2 as STA. The optimum value for the suction surface turning angle depends on the Mach No. and is also a tradeoff since too large an amount of turning can cause flow separation and too little turning will prevent the steam flow from accelerating properly. As can be seen, the suction surface turning angle has been maintained below 16° at the base of the airfoil and below 9° at the tip to ensure that boundary layer separation does not occur in the trailing edge 26 region.

Figure 3:
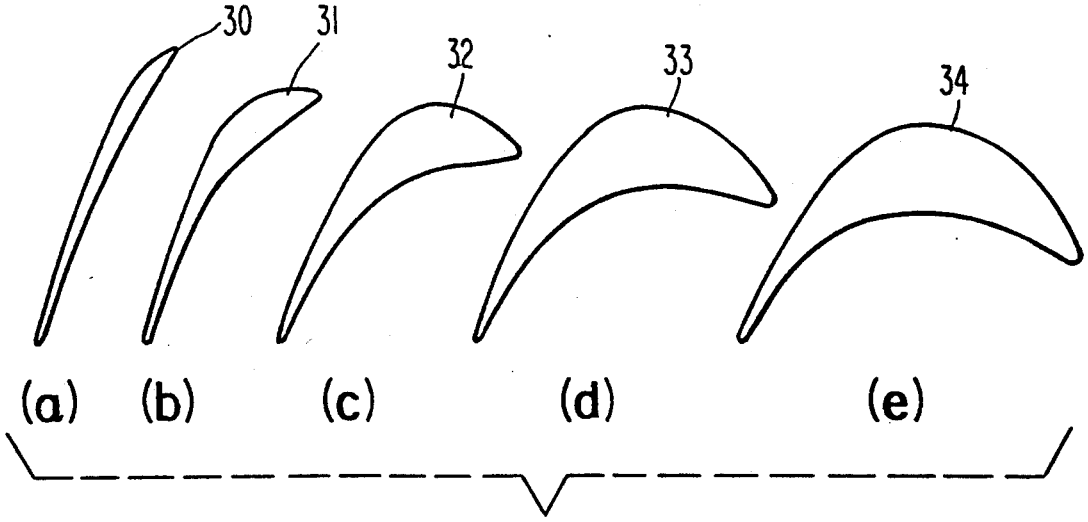
FIGS. 3 (*a*)-(*e*) are a series of transverse cross-sections through the blade shown in FIG. 1 at various radial locations.
Figure 5:
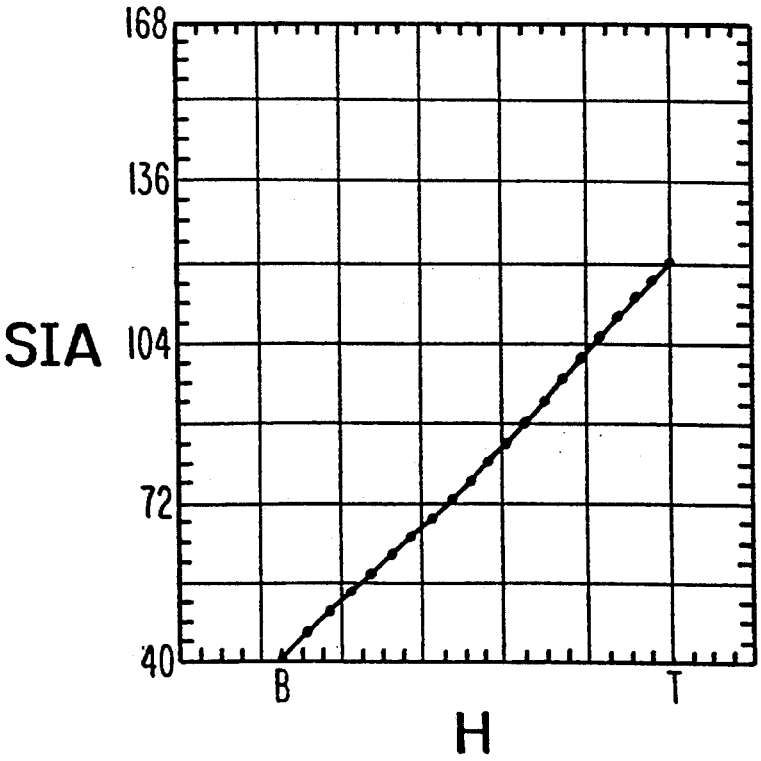
FIG. 5 is a graph showing the calculated radial distribution of the inlet flow angle of the steam as it enters the blade row according to the current invention from the base B of the airfoil to the tip T.

The blade airfoil 11 according to the current invention exhibits a high degree of twist per inch as it extends from the base to the tip. This high rate of twist is indicated by the fact that although the blade is only approximately 254 mm (10 inches) in length, angle of the principal coordinate axis, shown in Table II below, varies from approximately 13° at the base 15 of the airfoil to approximately 69° at the tip 16. Thus, the overall airfoil exhibits a rate of twist, as measured by the rate of change in the angle of the principal coordinate axis, of approximately 0.22° /mm (5.6° /inch). This high rate of twist, along with the overall shape of the airfoil is also illustrated in FIG. 3, which shows transverse cross-sections taken at the tip 16 of the airfoil in FIG. 3(*a*), at 25% height in FIG. 3(*b*), at mid-height in FIG. 3(*c*), at 75% height in FIG. 3(*d*), and at the base 15 of the airfoil in FIG. 3(*e*), indicated by reference numerals 30, 31, 32, 33, and 34, respectively. The high rate of twist is also indicated in FIG. 5, which shows that the steam inlet angle SIA, defined in FIG. 2, varies form approximately 40° at the base of the airfoil to 120° at the tip.

Figure 9:
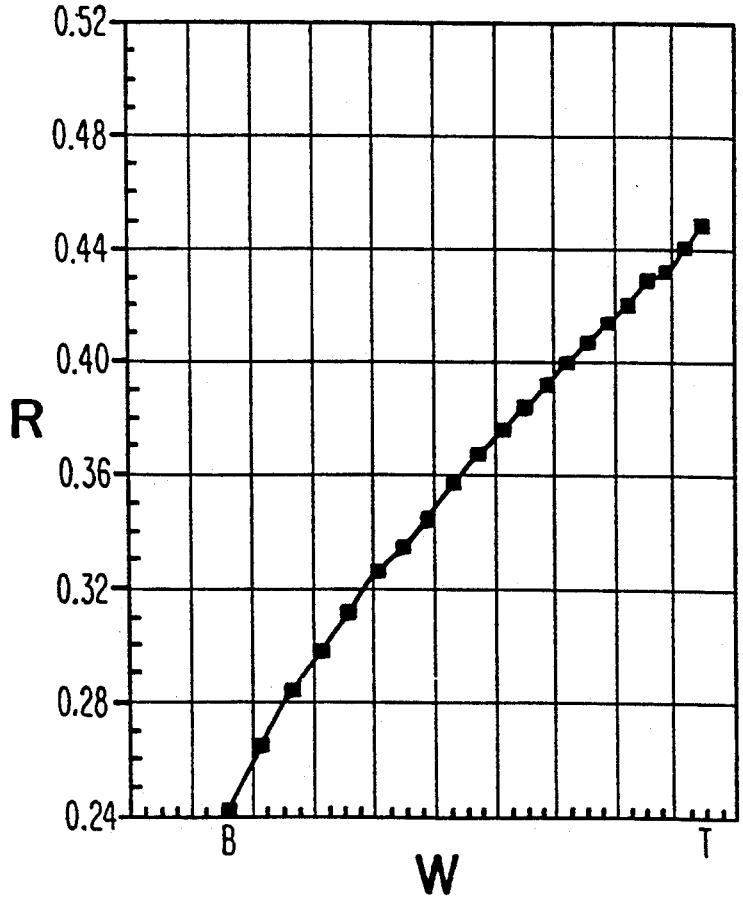
FIG. 9 is a graph showing the calculated radial distribution of the reaction R for the stage shown in FIG. 1.

Such a high rate of twist is necessary in the blade according to the current invention to obtain the radial reaction distribution shown in FIG. 9 and to match the inlet flow angles for the downstream stages. Since the centrifugal force on the blade tends to untwist the airfoil during operation, such a large amount of twist had heretofore been thought unobtainable on L-2R blades. However, the high rate of twist in the blade according to the current invention is maintained by the use of the integral shroud 13 that prevents the airfoil 11 from untwisting.

The novel shape of the blade airfoil 11 according to the current invention, as specified in Table I and illustrated in FIGS. 3(*a*)-(*e*), allows the steam 7 to expand across the blade row with a minimum amount of energy loss. As previously discussed, major losses in the blade row may occur primarily due to four phenomena—(i) friction losses as the steam flows over the airfoil surface, (ii) losses due to separation of the boundary layer on the suction surface of the blade, (iii) secondary flows in the steam flowing through the channel formed by adjacent blades and the end walls, and (iv) steam leakage past the blade tip. Accordingly, the blade airfoil shape according to the current invention addresses each of these sources of steam energy loss.

Figure 6:
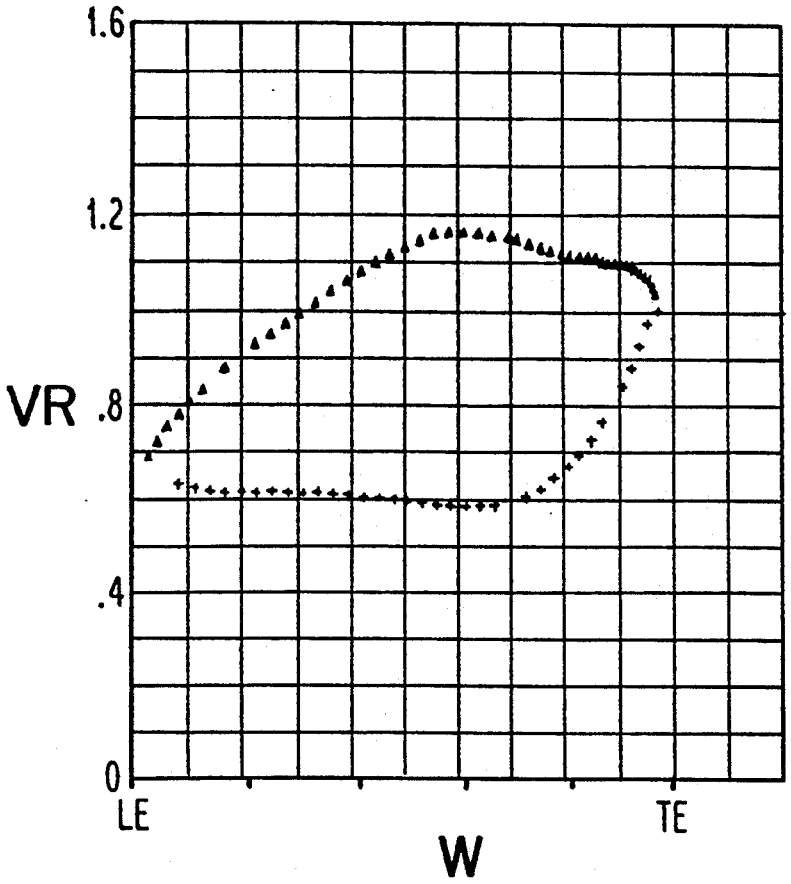
FIGS. 6, 7 and 8 are graphs showing the calculated axial distribution of the steam velocity ratio VR—that is, the local surface velocity to the blade row exit velocity—along the width W of the airfoil, from the leading edge LE to the trailing edge TE, over the blade suction surface, indicated by the triangles, and the blade pressure surface, indicated by the crosses, at three radial stations—the base of the airfoil, mid-height and 75% height, respectively.
Figure 7:
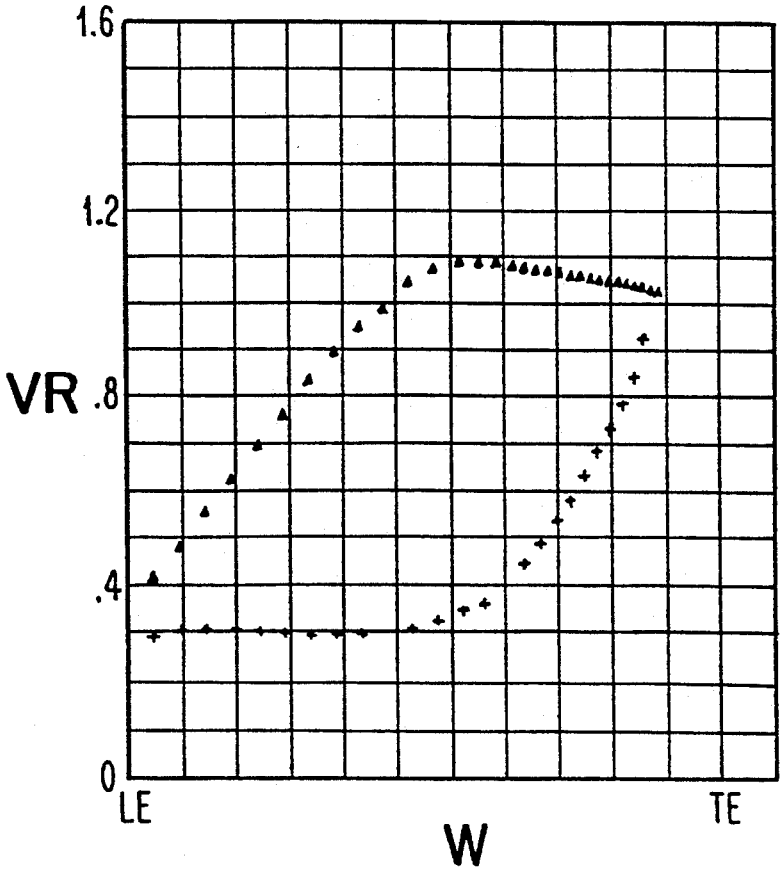
Figure 8:
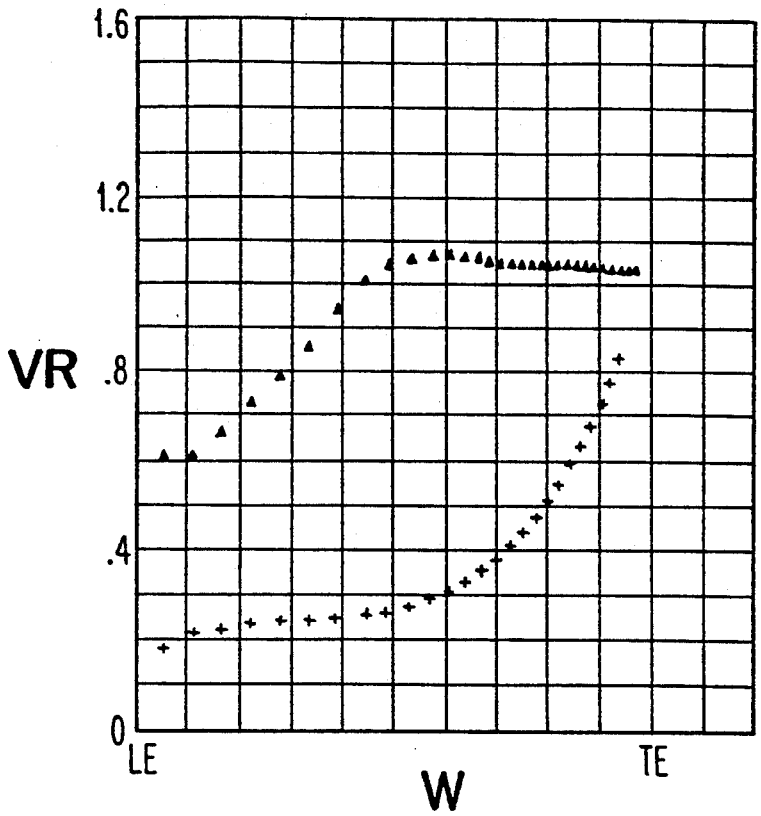

Thus, in the blade according to the current invention, friction losses are minimized by configuring the airfoil shape so as to maintain the velocity of the steam at relatively low values, as shown in FIGS. 6–8. Specifically, FIGS. 6–8 show that the velocity ratio—that is, the variation in the ratio of the steam velocity at the surface of the airfoil at a given radial station to the velocity of the steam exiting the blade row at that radial station—on both the convex suction surface 14 and the concave pressure surface 18, indicated by the triangles and plus-signs, respectively, along the entire width of the airfoil is less than 1.2. Such advantageous velocity profiles are made possible by the blade surface contour, shown in FIG. 3, the amount of turning and the convergence of the steam passage.

FIGS. 6–8 also show that in the blade according to the current invention separation of the boundary layer is prevented by configuring the airfoil geometry to ensure that the steam does not decelerate too rapidly as it expands toward the trailing edge of the airfoil. As can be seen, in both the FIGS. 7 and 8, respectively, the velocity ratio on the suction surface decreases by less than 10% from its peak, at approximately mid-width, to its value at the trailing edge. In addition, in the base region 15, as shown in FIG. 6, the velocity ratio decreases by less than 20% from its peak to its value at the trailing edge 26 and does not drop from its maximum value by more than 10% until very near the trailing edge. Such gentle decelerations ensure that boundary layer separation, and the associated loss in steam energy, does not occur.

In the blade according to the current invention, losses due to secondary flow and tip leakage are minimized by adjusting the airfoil geometry to provide a novel radial reaction distribution along the airfoil height. Unlike blades typically used in the art, in the blade according to the current invention, the reaction varies from at least 20% at the base of the airfoil to less than 50% at the tip. Preferably, the reaction varies from a relatively high value of approximately 25% at the base 15 of the airfoil to a relatively low value of approximately 45% at the tip 16, as shown in FIG. 9. This novel reaction distribution has been obtained by carefully adjusting the blade airfoil parameters, especially the radial gauging distribution of the blade row, as shown in FIG. 4. The geometry of the airfoils of the upstream row of vanes 4 should also be selected to match the blades. The upstream row of vanes 4 for the blade according to the current invention is disclosed in our co-pending application Ser. No. 07/851,711, filed Mar. 16, 1992.

The relatively high reaction at the base of the airfoil in the blades according to the current invention indicates that the pressure drop is high, resulting in a greater tendency for the steam flow to accelerate. Such acceleration has the salutary effect of "pushing" the steam flow through the blade row before harmful secondary flows, which have a tendency to form at the base of the airfoil, can build up. The relatively low reaction at the tip of the airfoil indicates that the pressure drop is low. Since the pressure drop is the driving force for tip leakage, such low reaction at the tip will mean low tip leakage losses.

The mechanical properties of the blade having the geometry defined in Table I are shown in Table II. The principal coordinate axes of the airfoil are indicated in FIG. 2 as MIN and MAX. The minimum and maximum second moments of inertia about these axes are shown in Table II as by $I_{min}$ and $I_{max}$, respectively. The radial distribution of $I_{min}$ and the cross-sectional area have a strong influence on the first vibratory mode. The radial distribution of $I_{max}$ and the cross-sectional area have a strong influence on the second vibratory mode. Hence, it is important that these values be adjusted so as to avoid resonance. The distances of the leading and trailing edges from the principal coordinate axes are designed by D. The angle the principal coordinate axis MIN makes with the axial direction is indicated in FIG. 2 as PCA.

TABLE II

| Parameter | Base | 25% | Mid-height | 75% | Tip |
|---|---|---|---|---|---|
| Cross-sectional Area ($mm^2$) | 1750 | 1452 | 942 | 523 | 362 |
| Angle of Principal Coordinate Axis | 12.6 | 23.4 | 42.1 | 56.0 | 68.5 |
| $I_{min}$ ($mm^4 \times 10^4$) | 19.6 | 12.2 | 4.2 | 0.86 | 0.12 |
| $I_{max}$ ($mm^4 \times 10^4$) | 97.3 | 68.9 | 39.5 | 23.7 | 21.0 |
| $D_{min}$ LE (mm) | −26 | −23 | −18 | −11 | −6 |
| $D_{max}$ LE (mm) | 42 | 36 | 31 | 31 | 38 |
| $D_{min}$ TE (mm) | −33 | −26 | −16 | −9 | −4 |
| $D_{max}$ TE (mm) | −58 | −57 | −56 | −55 | −53 |

The L-2R blade operates in the transition zone where condensation may occur. The moisture associated with such condensation can cause erosion as well as salt deposits that lead to corrosion. In addition, the blades may be exposed to excessive vibratory excitation due to operation near the Wilson line. Consequently, the blade has been provided with adequate strength to operate in resonance and withstand a certain amount of erosion and corrosion. In addition, the first vibratory mode has been tuned to avoid harmonics of running speed frequency (i.e., 60 Hz.).

The present invention may be embodied in other specific forms without departing from the spirit or essential attributes thereof and, accordingly, reference should be made to the appended claims, rather than to the foregoing specification, as indicating the scope of the invention.

We claim:

1. A steam turbine comprising:

a) a stationary cylinder for containing a steam flow, and a rotor enclosed by said cylinder;

b) a stage disposed within said cylinder and having means for at least partially expanding said steam flow, whereby said steam flow undergoes a stage pressure drop as it expands through said stage, said stage having a row of vanes and a row of blades, said row of blades having a tip region and a hub region;

c) said row of vanes having means for causing said steam to undergo a first portion of said stage pressure drop as said steam flows through said row of vanes; and d) said row of blades having (i) means for causing said steam to undergo a second portion of said stage pressure drop as said steam flows through said row of blades, and (ii) means for controlling the radial distribution of said second portion of said stage pressure drop so that said second portion is greater than 20% of said stage pressure drop in said hub region and less than 50% of said stage pressure drop in said tip region, e) said pressure drop radial distribution control means comprising(i) each of said blades having an airfoil portion having a base section, a mid-height section, a 25% height section between said base and mid-height sections, a 75% height section between said mid-height section and said tip region, and each of said airfoil portions being defined by the following parameters having approximately the values indicated below, all angles being expressed in degrees:

| Parameter | 25% Height | Mid-Height | 75%-Height |
|---|---|---|---|
| Pitch/Chord Ratio | 0.6 | 0.7 | 0.8 |
| Pitch/Width Ratio | 0.7 | 0.9 | 1.3 |
| Stagger Angle | 25 | 41 | 54 |
| Max Thickness/Chord Ratio | 0.3 | 0.2 | 0.1 |
| Metal Turning Angle | 106 | 84 | 62 |
| Exit Opening (mm) | 21 | 21 | 22 |
| Exit Opening Angle | 33 | 31 | 30 |
| Inlet Metal Angle | 55 | 78 | 102 |
| Inlet Included Angle | 42 | 51 | 40 |
| Exit Metal Angle | 20 | 19 | 17 |
| Suction Surface Turning Angle | 16 | 15 | 14 |

2. The steam turbine according to claim 1, wherein each of said airfoil portions is further defined by the following parameters having approximately the values indicated below, all angles being expressed in degrees:

| Parameter | Base | Tip |
|---|---|---|
| Pitch/Chord Ratio | 0.5 | 0.8 |
| Pitch/Width Ratio | 0.5 | 2.0 |
| Stagger Angle | 17 | 67 |

-continued

| Parameter | Base | Tip |
|---|---|---|
| Max Thickness/Chord Ratio | 0.3 | 0.1 |
| Metal Turning Angle | 116 | 36 |
| Exit Opening (mm) | 21 | 19 |
| Exit Opening Angle | 33 | 23 |
| Inlet Metal Angle | 43 | 129 |
| Inlet Included Angle | 30 | 33 |
| Exit Metal Angle | 21 | 15 |
| Suction Surface Turning Angle | 16 | 9 |

3. In a steam turbine, a row of blades comprising an airfoil for each blade, each of said airfoils having a base section, a mid-height section, a tip section, a 25% height section between said base and mid-height sections, a 75% height section between said mid-height and tip sections, and defined by the following parameters having approximately the values indicated below, all angles being expressed in degrees:

| Parameter | 25% Height | Mid-Height | 75%- Height |
|---|---|---|---|
| Pitch/Chord Ratio | 0.6 | 0.7 | 0.8 |
| Pitch/Width Ratio | 0.7 | 0.9 | 1.3 |
| Stagger Angle | 25 | 41 | 54 |
| Max Thickness/Chord Ratio | 0.3 | 0.2 | 0.1 |
| Metal Turning Angle | 106 | 84 | 62 |
| Exit Opening (mm) | 21 | 21 | 22 |
| Exit Opening Angle | 33 | 31 | 30 |
| Inlet Metal Angle | 55 | 78 | 102 |
| Inlet Included Angle | 42 | 51 | 40 |
| Exit Metal Angle | 20 | 19 | 17 |
| Suction Surface Turning Angle | 16 | 15 | 14 |

4. The row of blade airfoils according to claim 3, further defined by the following parameters having approximately the values indicated below, all angles being expressed in degrees:

| Parameter | Base | Tip |
|---|---|---|
| Pitch/Chord Ratio | 0.5 | 0.8 |
| Pitch/Width Ratio | 0.5 | 2.0 |
| Stagger Angle | 17 | 67 |
| Max Thickness/Chord Ratio | 0.3 | 0.1 |
| Metal Turning Angle | 116 | 36 |
| Exit Opening (mm) | 21 | 19 |
| Exit Opening Angle | 33 | 23 |

-continued

| Parameter | Base | Tip |
|---|---|---|
| Inlet Metal Angle | 43 | 129 |
| Inlet Included Angle | 30 | 33 |
| Exit Metal Angle | 21 | 15 |
| Suction Surface Turning Angle | 16 | 9 |

5. The row of blade airfoils according to claim 4, further defined by a gauging parameter, said gauging parameter varying from approximately 0.4 at said base portion to approximately 0.3 at said tip portion.

6. The row of blade airfoils according to claim 4, wherein each of said airfoils has a shroud formed on said tip portion.

7. In a steam turbine having a stage having a row of stationary vanes and a row of rotating blades, (iii) a tip region, and (iv) a hub region, a method of at least partially expanding a flow of steam across said stage, whereby said steam undergoes a stage pressure drop, comprising the steps of:

a) causing said steam flow to undergo a first portion of said stage pressure drop by flowing through said row of vanes; and b) causing said steam flow to undergo a second portion of said stage pressure drop by the step of flowing said steam through a row of blade airfoils having a base portion and a mid-height portion, and defined by the following parameters having approximately the values indicated below, all angles being expressed in degrees:

| Parameter | Base | Mid | Tip |
|---|---|---|---|
| Pitch/Chord Ratio | 0.5 | 0.7 | 0.8 |
| Pitch/Width Ratio | 0.6 | 0.9 | 2.0 |
| Stagger Angle | 17 | 41 | 67 |
| Max Thickness/Chord Ratio | 0.3 | 0.2 | 0.1 |
| Metal Turning Angle | 116 | 84 | 36 |
| Exit Opening (mm) | 21 | 21 | 19 |
| Exit Opening Angle | 33 | 31 | 23 |
| Inlet Metal Angle | 43 | 78 | 129 |
| Inlet Included Angle | 30 | 51 | 33 |
| Exit Metal Angle | 21 | 19 | 15 |
| Suction Surface Turning Angle | 16 | 15 | 9 |

so as to control the radial distribution of said second portion of said stage pressure drop so that said second portion is greater than 20% of said stage pressure drop in said hub portion and less than 50% of said stage pressure drop in said tip region.

* * * * *